United States Patent [19]

Uchida

[11] 4,314,662

[45] Feb. 9, 1982

[54] SWINGING TYPE ROTORS OF CENTRIFUGAL MACHINES

[75] Inventor: Tadahiro Uchida, Tokyo, Japan

[73] Assignee: Kabushiki Kaisha Kubota Seisakusho, Tokyo, Japan

[21] Appl. No.: 189,178

[22] Filed: Sep. 22, 1980

[30] Foreign Application Priority Data

Dec. 31, 1979 [JP] Japan ..... 54-183043

[51] Int. Cl.[3] ..... B04B 9/12

[52] U.S. Cl. ..... 233/26

[58] Field of Search ..... 233/26, 27; 57/76

[56] References Cited

U.S. PATENT DOCUMENTS 3,722,791 3/1973 Wright ..... 233/26

4,009,824 3/1977 Wright ..... 233/26

*Primary Examiner*—Billy J. Wilhite

*Attorney, Agent, or Firm*—Charles E. Pfund

[57] ABSTRACT

In a swinging type rotor of a centrifugal machine of the type wherein the rotor is provided with a plurality of equally spaced radial arms and each arm is provided with a pair of trunnion pins for hanging buckets, a through opening extending in a direction perpendicular to a longitudinal axis of each arm is formed near an outer end thereof. A holding shaft with its opposite end surfaces inclining away from the longitudinal axis is non-rotatorily inserted into the through opening and a pair of trunnion pins are threaded into the opposite end surfaces to hang buckets. Directions of screw threads of the pair of trunnion pins are opposite so that when the buckets are swung under centrifugal force, threading of the trunnion pins are tightened.

6 Claims, 6 Drawing Figures

SWINGING TYPE ROTORS OF CENTRIFUGAL MACHINES

BACKGROUND OF THE INVENTION

This invention relates to a centrifugal machine in which centrifugal force is applied to a sample for effecting separation or precipitation, more particularly, a so-called swinging type rotor wherein buckets containing the sample are hung on arms of the rotor and rotated thereby.

One example or a so-called Beckman type centrifugal machine is disclosed in U.S. Pat. No. 4,009,824 issued to Herchel E. Wright on Mar. 1, 1977. The centrifugal machine disclosed therein comprises a plurality of radially extending arms which are equally spaced apart in the circumferential direction. Each arm is provided with a single opening near the outer end thereof perpendicularly to the longitudinal axis of the arm. A trunnion pin is inserted through the opening and has arcuately oriented opposite extremities acting as trunnions. Buckets are swingably hung on opposing extremities of adjacent arms. With this construction, the diameter of the openings through which the trunnion pins extend to become large, thus increasing the thickness of the arms. To obviate this difficulty, it is necessary to make the trunnion pins thin. When the diameter of the trunnion pins is reduced it is necessary to make them with a material having a high mechanical strength. This, however, reduces the bearing areas of the buckets so that it is necessary to make also the bucket with a strong materials. These limitations increases the cost of manufacturing.

Another prior art swinging type rotor is shown in FIGS. 1 and 2 of the accompanying drawings. A rotor 11 shown therein has an opening 13 at the central portion thereof 12 to receive a rotating shaft of a driving motor not shown. A plurality of integral arms 14 equally spaced apart in the circumferential direction extend in the radial direction. At the outer end of each arm are inserted trunnion pins 15, the axes thereof intersecting at an angle. Buckets 16 are hung on opposing trunnion pins 15 adjacent arms 14. More particularly, each bucket is guided by a pair of parallel recesses 17 formed on both sides of the bucket so that the upper ends of the recesses 17 engage the ends of the trunnion pins to hang the buckets to be swingable about the axes of the opposing trunnion pins. Although in FIGS. 1 and 2 only one bucket is shown it will be clear that six buckets are hung in the construction shown. As the rotor 11 is rotated, the buckets are swung from the dotted line position to the solid line position as shown in FIG. 2.

In the swinging type rotor, because the spacings between adjacent arms are narrow, it has been impossible or difficult to form openings for receiving the trunnion pins by insterting a tool into the narrow gaps between adjacent arms. For this reason, according to a prior art method of machining, openings 18 for receiving the trunnion pins 15 were formed through opposite side surfaces of the outer end of each arm. The axes of the openings 18 make acute angles with respect to the center line of each arm and the axes of the trunnion pins received in a pair of openings 18 of each arm cross each other with an angle. Accordingly, the thickness of the portions 19 on the outsides of the openings 18 as viewed from the center of the rotor 11 is small, so that these thin portions 19 would be ruptured or deformed under a strong centrifugal force. Rupture of the portions 19 results in fly off of the buckets thus causing a serious damage especially when the rotor is rotated at an extremely high speed.

SUMMARY OF THE INVENTION

Accordingly, it is an object of this invention to provide an improved swinging type rotor capable of operating at a sufficiently high speed so as to impart strong centrifugal force to the sample contained in the buckets.

Another object of this invention is to provide an improved swinging type rotor of a centrifugal machine according to which the rotor can be made of inexpensive and light metal or alloys thereof and it is possible to make only the trunnion pins of a material having a high mechanical strength.

According to this invention a through opening is formed near the outer end of each arm in a direction perpendicular to the axis thereof, and a single holding pin is tightly inserted into this opening so as not to rotate. On the opposite ends of the holding shaft are formed a pair of threaded openings having axes coinciding with the axis of swinging of each bucket. These threaded openings are formed obliquely with respect to the longitudinal axis of each arm and trunnion pins for hanging busckets are threaded into the threaded openings. Each trunnion pin is provided with an integral flange for limiting the extent of thread in of the trunnion pin. Moreover, the threads of each trunnion pin are cut such that the trunnion pin is tightened or threaded into the threaded opening as the bucket is swing by the centrifugal force and rotated by friction.

According to this invention, there is provided a swinging type rotor of a centrifugal machine, comprising a plurality of radial arms equally spaced apart in the circumferential direction, each arm being provided with a through opening near an outer end thereof, the through opening extending at a right angle with respect to a longitudinal axis of the arm and to an axis of rotation of the rotor, a holding shaft fitted into the through opening, the through opening having a noncircular cross-sectional shape so as to prevent rotation of the holding shaft relative to the arm, opposite end surfaces of the holding shaft inclining away from the longitudinal axis of the arm, and a pair of trunnion pins threaded into the opposite end surfaces to hung buckets, and directions of screw threads of the trunnion pins being selected such that threadings of the trunnion pins are tightened when the buckets are swing under centrifugal force to cause the trunnion pins to rotate.

Perferably the through opening of each arm has an elliptical cross-sectional configuration with its major width in a direction parallel with the longitudinal axis of each arm larger than that of a minor width in parallel with the axis of rotations. The trunnion pins have flanges which engage with the side surfaces of the arm to prevent disengagement of the holding shaft.

DESCRIPTION OF THE PREFERRED EMBODIMENTS

Figure 3:
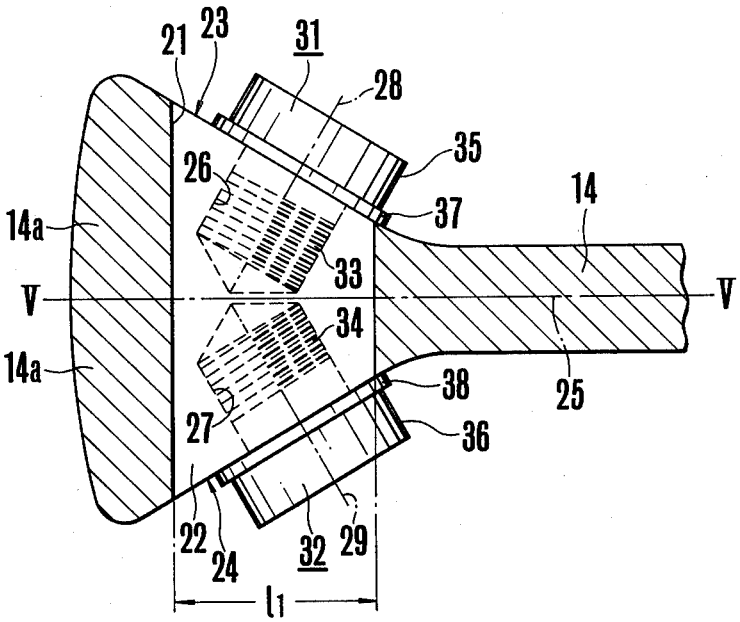
FIG. 3 is a transversal sectional view of a portion of a swinging type rotor embodying the invention.
Figure 4:
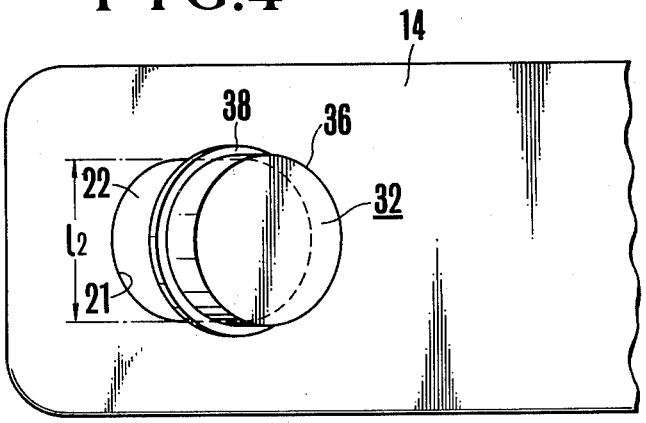
FIG. 4 is a plan view of the portion shown in FIG. 3.

As shown in FIGS. 3 and 4, according to this invention a through opening 21 is formed near the outer end of each arm 14 of the rotor in a direction perpendicular to the longtudinal axis 25 of the arm and to the axis of rotation of the rotor. A holding shaft 22 is snugly fitted into the through opening 21. The opposite surfaces 23 and 24 are inclined with respect to the longitudinal axis 25 such that their outer ends are separated away from the axis 25. These inclined surfaces 23 and 24 are substantially at a right angle with respect to the axes of the trunnion pins about which the buckets swing.

Threaded openings 26 and 27 are formed through the inclined surfaces and the axes of the threaded openings 26 and 27 coincide with the axes of swinging 28 and 29 of the buckets. One ends of trunnion pins 31 and 32 for hanging buckets are threaded into the threaded openings 26 and 27 respectively. Thus, each one end of the trunnion pins 31 and 32 is provided with screw threads 33 and 34 adapted to be received by the threaded openings 26 and 27. The other ends 35 and 36 of the trunnion pins projecting beyond the end surfaces 23 and 24 are shaped into short cylindrical portions for hunging the buckets. The screw threads 33 and 34 are received in the threaded openings 26 and 27 such that the screw threads 33 and 34 would be more lightly threaded into the threaded openings by a torque applied to the trunnion pins 31 and 32 due to friction created as the buckets hunging on the pins 31 and 32 are swing by the centrifugal force. More particularly, the righthand threaded opening 26 is provided with lefthand screw threads with respect to the axis of rotation of the rotor, which the lefthand threaded opening 27 is provided with righthand screw threads. In other words, when the pin 32 is rotated in the clockwise direction, it would be more tightly threaded into the threaded opening 27.

The trunnion pins 31 and 32 are provided with integral flanges 37 and 38 for limiting the extent of threading into the threaded openings 26 and 28. Portions of the flanges 37 and 38 engage with the side surface of the arm 14 to prevent the holding shaft 22 from disengaging the arm.

Figure 5:
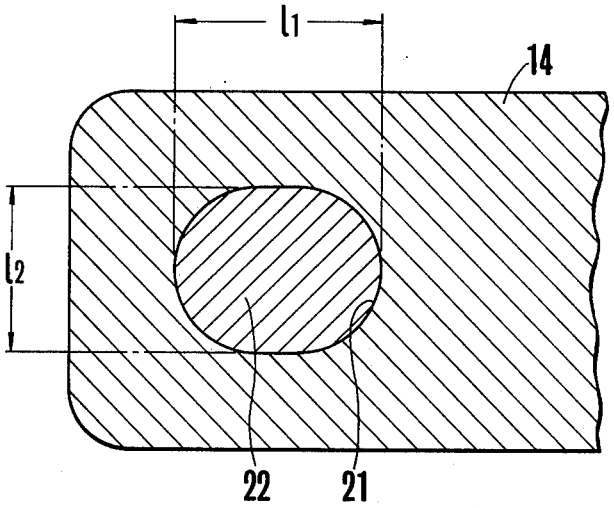
FIG. 5 is a sectional view taken along a line v—v in FIG. 3.

The holding shaft 22 is constructed such that it can not rotate about its axis. Thus, as shown in FIG. 5, the holding shaft 22 has an elliptical shape. Preferably, the length e, in a direction parallel to the longitudinal axis of the arm is larger than the length $l_2$ in a direction parallel with the axis of rotation of the rotor.

Figure 1:
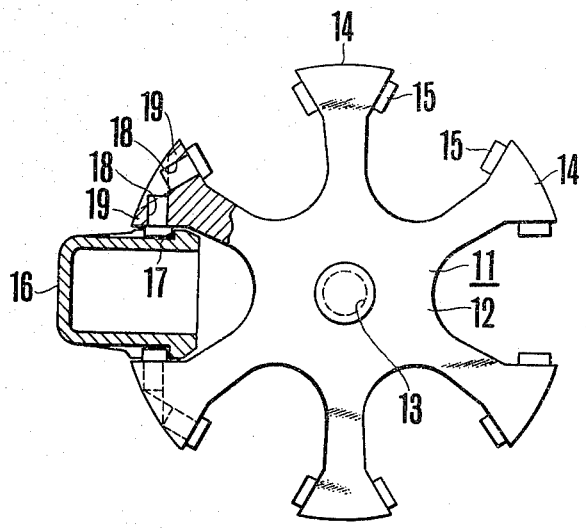
FIG. 1 PRIOR ART
FIG. 1 is a plan view showing one example of a prior art swinging type rotor.
Figure 2:
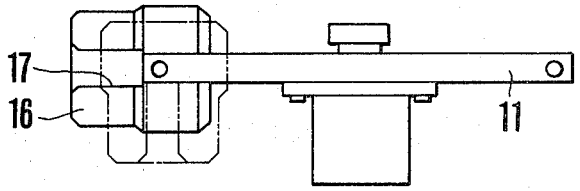
FIG. 2 PRIOR ART
FIG. 2 is a side view of the rotor shown in FIG. 1.
Figure 6:
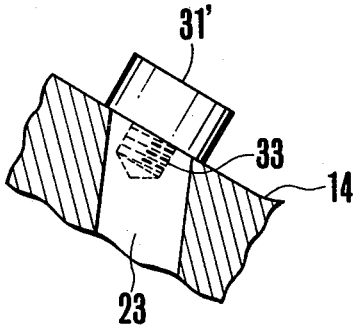
FIG. 6 is a partial side view showing a modified trunnion pin.

As shown in FIG. 6, the pin 31′ may have the same outer diameter up to the outer end. The lower end of this enlarged pin acts as a flange. As above described, according to this invention since the through opening 21 is formed in a direction perpendicular to the longitudinal axis of each arm of the rotor it is possible to form this through opening without being seriously interferred by adjacent arms. Moreover, the openings are not formed obliguely to the side surfaces of the arm as in the case of FIG. 1 and since relatively thick portions 14*a* are left on the opposite sides of the longitudinal axis 25 of the arm so that it is possible to withstand against a large centrifugal force applied to the buckets.

Securing of the holding shaft 22 to the arm 14 is automatically effected by the tightening action of the flanges 37 and 38 of the trunnion pins 31 and 32.

Although the trunnion pins 31 and 32 and the holding shaft 32 are subjected to forces tending to draw out them from the through opening 21, these forces balance with each other and moreover since the flanges 37 and 38 are engaging the both sides of the arm 14 there is no fear of drawing out the shaft 22.

As shown in FIG. 5, both the holding shaft 22 and the through opening 21 have noncircular shapes so that it is not necessary to drive a set screw from outside to prevent rotation and disengagement of the holding shaft 22. More particularly, it is not necessary to form an opening from the outside of the left portion, 14*a*, that is in a direction normal to the direction of rotation to receive such as screw.

As above described, the buckets are swung by a very large centrifugal force. At this time, the trunnion pins 31 and 32 are subjected to a large torque due to friction between the busckets and the trunnion pins. However, this torque acts to tighten the screw threads, not to loosen the same. As the buckets swing back as a result of stopping the rotor and disapperance of the centrifugal force, the torque acting upon the trunnion pins decreases, so that there is no fear of loosening the pins 31 and 32. As above described, since the trunnion pins are lightened when the buckets are swung to the operating position it is not necessary to provide any means for preventing loosening of the trunnion pins.

In order to increase the rotating speed of the rotor and hence the centrifugal force it is necessary to decrease the weight of the rotor. For this reason, the rotor is usually made of a light metalalloy. However, as the mechanical strength of the light metal alloy is not high it is difficult to hold the trunnion pins against the large centrifugal force even when the pins are directly threaded into the holding shaft. However, according to this invention it is possible to made the rotor of an inexpensive light metal alloy by using a material having a high mechanical strength for only the holding shaft 22. The rotor arm can receive the holding shaft 22 with a sufficiently large contact area sufficient to resist against the centrifugal force. As above described the holding shaft 22 has an elliprical sectional configuration and by making $l_1 > l_2$ (see FIG. 5) it is possible to decrease the thickness of the arm, thus decreasing the weight of the rotor. Moreover, as the trunnion pins for hanging the buckets are threaded into the holding shaft, it is possible to make the diameters of the trunnion pins to be larger than the minor diameter $l_2$ of the elliptical holding shaft, thus increasing the diameter of the bucket hunging portons 35 and 36. This alleviates the necessity of increasing the thickness of the arms, thus decreasing the weight of the rotor.

What is claimed is:

1. A swinging type rotor of a centrifugal machine comprising a plurality of radial arms equally spaced apart in the circumferential direction, each arm being provided with a through opening near an outer end thereof, said through opening extending at a right angle with respect to a longitudinal axis of said arm and to an axis of rotation of said rotor; a holding shaft fitted into said through opening, said through opening having a noncircular cross-sectional shape so as to prevent rotation of said holding shaft relative to said arm, opposite end surfaces of said holding shaft inclining away from said longitudinal axis of said arm; and a pair of trunnion pins threaded into said opposite end surfaces to hang buckets, and the directions of screw threads of said trunnion pins being selected such that threadings of said trunnion pins are tightened when said buckets are swung under centrifugal force to cause said trunnion pins to rotate.

2. The swinging type rotor according to claim 1 wherein said through opening has an elliptical cross-sectional configuration, a major width of said opening in parallel with said longitudinal axis of each arm being larger than a minor width in parallel with said axis of rotation.

3. The swinging type rotor according to claim 1 wherein the directions of the screw threads of the trunnion pins respectively threaded into the opposite end surfaces of said holding shaft are opposite.

4. The swinging type rotor according to claim 1 wherein each of said trunnion pins has a flange engaging a portion of a side surface of each arm.

5. The swinging type rotor according to claim 1 wherein each of said trunnion pin has a diameter sufficient to engage a portion of a side surface of each arm.

6. The swinging type rotor according to claim 1 wherein each arm is made of a light alloy and each supporting shaft is made of material having a high mechanical strength.

* * * * *